United States Patent [19]

Evans

[11] 4,123,639

[45] Oct. 31, 1978

[54] SUPPORT ASSEMBLY FOR A CIRCUIT INTERRUPTING DEVICE

[75] Inventor: David M. Evans, Palatine, Ill.

[73] Assignee: S & C Electric Company, Chicago, Ill.

[21] Appl. No.: 837,243

[22] Filed: Sep. 27, 1977

[51] Int. Cl.[2] ..... H01H 1/42

[52] U.S. Cl. ..... 200/254; 200/48 A

[58] Field of Search ..... 200/48 A, 48 KB, 48 R, 200/153 H, 252, 253, 254, 255, 256

[56] References Cited

U.S. PATENT DOCUMENTS

| | | | |
|---|---|---|---|
| 3,118,032 | 1/1964 | Davis | 200/254 X |
| 3,671,689 | 6/1972 | Falvo | 200/254 X |
| 3,676,629 | 7/1972 | Evans et al. | 200/254 |
| 3,705,374 | 12/1972 | Stanback | 200/254 X |

*Primary Examiner*—George T. Hall

*Attorney, Agent, or Firm*—John D. Kaufmann

[57] ABSTRACT

An improved support assembly for a circuit-interrupting device is disclosed. The device is of a type having first and second end fittings which define a major axis and which are selectively engageable and disengageable from matching first and second mountings spaced apart in the assembly in insulated relation. The device can be manipulated by a hookstick selectively attachable to the first end fitting and held by a human operator, and so manipulated as to selectively engage and disengage the end fittings and their respective mountings and to open and close the device. The second mounting has a non-circular pin which can be slideably received in a slot in the second end fitting only when the second end fitting and the device are in one particular orientation. The slot contains an enlargement which permits the second end fitting to rotate in the second mounting once the pin enters the enlargement. When the pin is in the enlargement, the device is freely rotatable to both the closed position and the opened position. A cradle, provided on the second mounting for supporting the device, is utilized at two times. First, the cradle supports the device when the second end fitting is being engaged with the second mounting. It performs such support function to automatically place the second end fitting in the one orientation in which it may slideably engage the end fitting. Second, the cradle arrests rotation of, and supports, the device following an opening operation during which the first end fitting is disengaged from the first mounting. Such arresting and support function also automatically aligns the pin in the slot so that the device may be removed from the second mounting.

25 Claims, 8 Drawing Figures

SUPPORT ASSEMBLY FOR A CIRCUIT INTERRUPTING DEVICE

BACKGROUND OF THE INVENTION

1. Field of the Invention

The present invention relates to an improved support assembly for a circuit-interrupting device, and more particularly to an improved support assembly for a massive circuit-interrupting device normally intended for dead circuit manipulation.

2. Description of the Prior Art

Support assemblies for circuit-interrupting devices, such as high-voltage fuses, are well known. Such support assemblies have taken many forms and have been adapted for use with a wide variety of circuit-interrupting devices. Although the devices may be mounted in just about any position, prior art support assemblies generally include an upper and a lower mounting which are selectively engageable with respective upper and lower end fittings on the circuit-interrupting device. Often the lower end fitting and mounting cooperate to permit not only engagement between the two, but also rotation of the lower end fitting in the lower mounting. This rotation permits rotation of the device about the lower mounting. Also generally speaking, the upper end fitting and upper mounting are selectively engageable. The rotation of the device about the lower mounting permits selective engagement and disengagement of the upper end fitting and mounting. When both end fittings engage both mountings, the device is referred to as being in the closed position wherein a circuit is completed therethrough. When the lower end fitting has been rotated in the lower mounting to permit disengagement of the upper end fitting and mounting, the fuse is in the so-called opened position and the circuit therethrough is open. Such prior art support assemblies are very common in enclosures which house a variety of electrical gear. They permit easy manipulation of the devices, including easy insertion or mounting and removal or demounting of the devices from the enclosures.

Some circuit-interrupting devices are rather massive, that is, are quite heavy and large. Because of their size and weight, such devices, often current-limiting fuses, have usually not been supported by support assemblies as described above. This is because their size renders difficult the rotation of the device within the cramped quarters of an enclosure, and because their weight is felt to place too great a strain on prior art end fittings and mountings during opening and closing operations.

Typically, such massive circuit-interrupting devices have been designed and built to accommodate so-called dead circuit manipulation. Specifically, the circuit in which such devices are contained is first de-energized prior to manipulation thereof. Then, the device is manually grasped by an operator who removes the device from, or places the device in, its support assembly. These support assemblies generally comprise spring-clips or similar apparatus.

Circuit-interrupting devices usable with the rotational mountings and end fittings, as described above, may be adapted for rotation to disengage their first end fitting and mounting in such a manner as to effect circuit or load interruption. In this event, the upper mounting is replaced by or contains a circuit interrupter, for example the type of circuit interrupter disclosed in copending, commonly-assigned United States patent application, Ser. No. 660,872 filed on Feb. 24, 1976. Because massive circuit interrupting devices have not been adaptable to such rotational mountings, it has not been possible to mount such circuit-interrupting devices in such a way that movement thereof could effect circuit interruption. Accordingly, not only are such massive devices generally used only in a dead circuit manner, but also such devices have hitherto been unable to perform a load breaking function upon manipulation thereof.

SUMMARY OF THE INVENTION

Thus, one object of the present invention is to provide an improved support assembly for a current-interrupting device.

Another object of the present invention is to provide an improved support assembly for a massive circuit-interrupting device to render such device more easily manipulatable than it is in dead circuit manipulation, and to permit the device to perform a load breaking function.

With these and other objects in view, the present invention contemplates an improved support assembly for a circuit-interrupting device. Regardless of the configuration or size of the device, it has first and second end fittings on respective ends thereof. The end fittings define a major axis of the device. The end fittings are engageable with, and disengageable from, respective first and second mountings. The mountings are spaced apart in the assembly in an insulated relation. A hook-stick held by a human operator is selectively attachable to the first end fitting for manipulating the device to engage and disengage the end fittings and their respective mountings.

The improvement includes a first facility which permits the slideable engagement and disengagement of the second mounting and the second end fitting in only one orientation of the second end fitting and of the device. A preferred form for this first facility includes an elongated pin and an elongated slot which receives the pin. The pin is fixed to the second mounting and has a noncircular portion thereon. This noncircular portion has apparent maximum and minimum dimensions when viewed from about the longitudinal axis of the pin. The elongated slot, which slideably receives the noncircular pin portion transversely thereof, is formed in the second end fitting and has an opened first end and a closed second end. The slot has a width greater than the apparent minimum dimension of the noncircular pin portion and smaller than all other apparent dimensions thereof. Accordingly, the second end fitting can slideably engage the second mounting only when the width of the slot is parallel to the apparent minimum pin dimension.

The improved support assembly also includes a second facility which permits rotation of the second end fitting in the second mounting after slideable engagement therebetween has been effected. Rotation of the second end fitting in the second mounting rotates the device about the second end fitting. A preferred form of this second facility includes an enlargement at the second, closed end of the slot. This enlargement is designed to slideably engage and disengage to rotatably receive the noncircular pin portion and has a diametric dimension greater than the apparent maximum dimension of the noncircular pin portion.

The improved support assembly also includes a third facility which supports the device to position the second end fitting and the device in the one orientation whereat the second mounting and the second end fitting may be slideably engaged and disengaged. A preferred form of this third facility is a cradle-like member on the second mounting which supports the device to align the slot with the noncircular pin portion so that the slot may slideably receive the pin about its apparent minimum dimension.

Preferably the cradle means supports the device intermediate the end fittings. The cradle slideably supports the circuit-interrupting device during the sliding engagement and disengagement of the second end fitting and in the second mounting. The cradle also supports the device to arrest its rotation following disengagement of the first end fitting and the first mounting due to rotation of the second end fitting in the second mounting.

DETAILED DESCRIPTION

Figure 1:
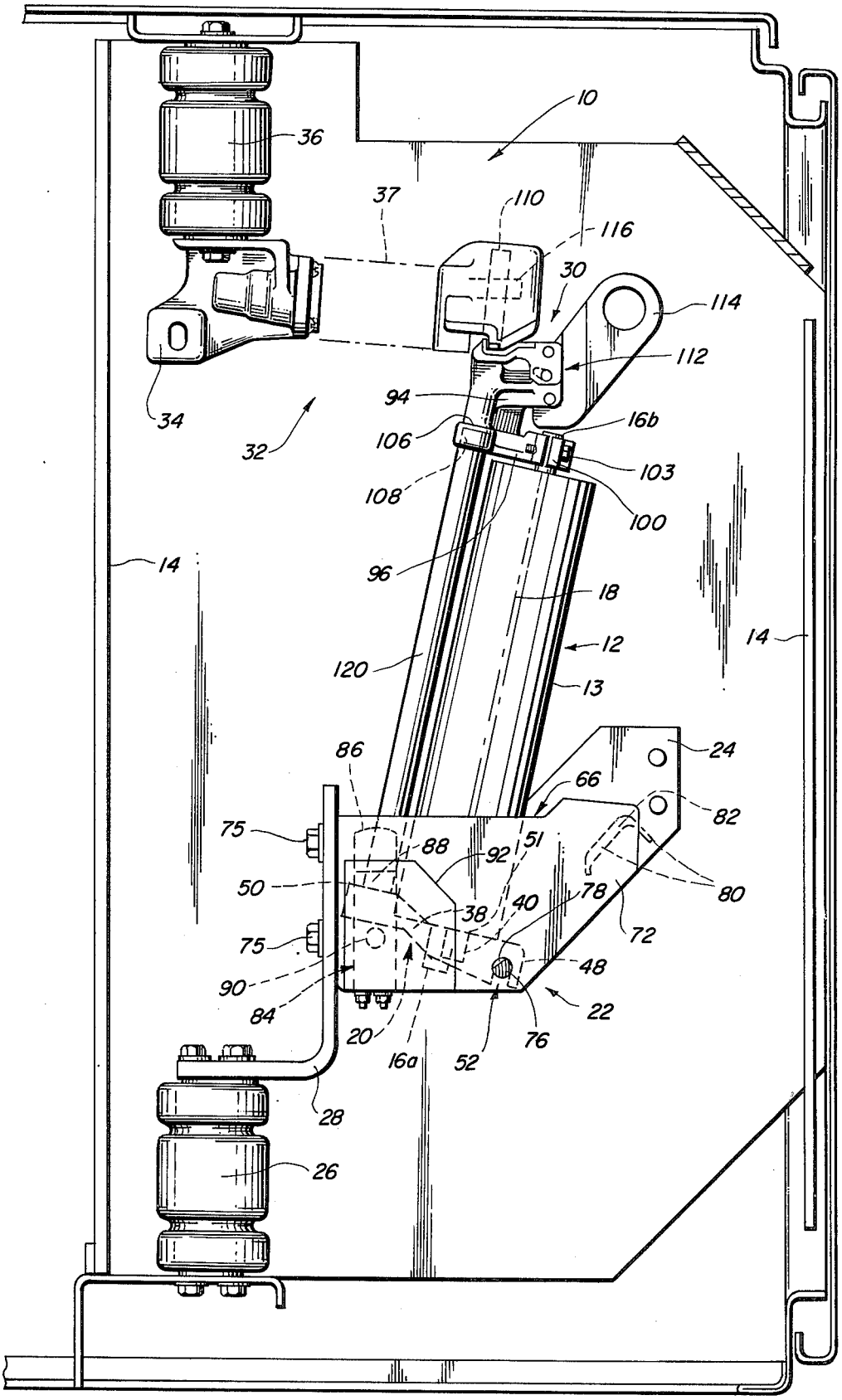
FIG. 1 is a side, elevational view of an improved support assembly for a circuit-interrupting device according to the principles of the present invention with the circuit-interrupting device in the closed position.
Figure 2:
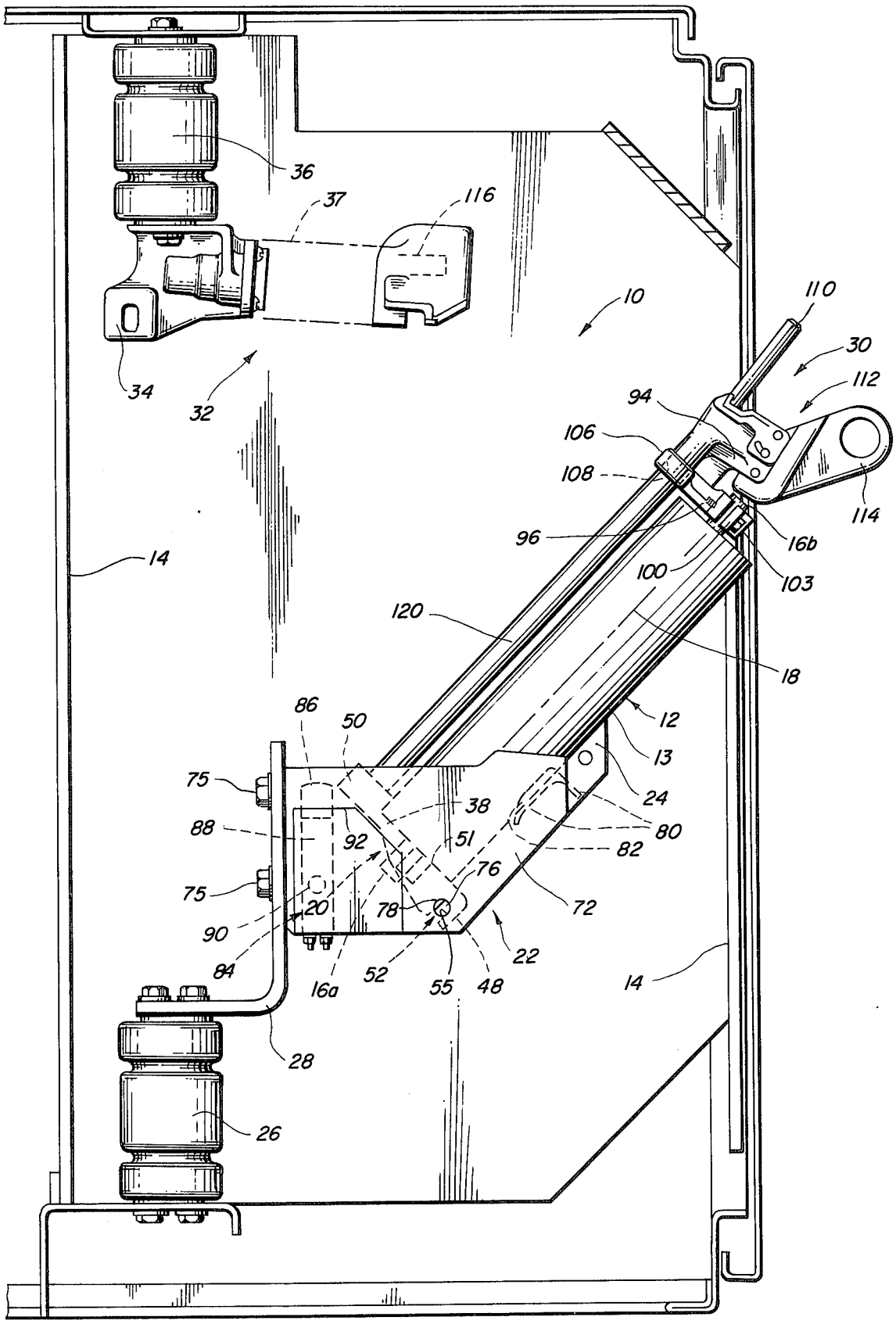
FIG. 2 is a view similar to FIG. 1 in which the circuit-interrupting device is in the opened position.

Referring first to FIGS. 1 and 2, there is shown as assembly 10 according to the present invention for supporting a circuit-interrupting device 12. The device 12 may be rather massive, and is typically a current-limiting fuse designed and built for dead circuit manipulation by an operator. In typical use, a body 13 of the device 12 is manually grasped during manipulation thereof to mount or demount the device 12. The device 12 may be larger, smaller, or differently configured from that depicted herein, and may be a fuse, current-limiting or otherwise, or other circuit interrupting device. Moreover, the device 12 need not be primarily intended for dead circuit manipulation. Regardless of the nature of the device 12, the support assembly 10 permits the mounting and demounting thereof to impart to the device 12 both the ability to be conveniently tool-handled, and, if desired, the capability of load switching. Preferably, the assembly 10 mounts the device 12 in an enclosure 14 or other confined space, where compactness and ease of manipulation of the device 12 are uppermost considerations.

As already noted, the device 12 may be a current-limiting fuse having large dimensions and weighing substantially more than typical circuit-interrupting devices or fuses usually found in enclosures 14. As described more completely below, the assembly 10 permits compact mounting of the device 12 in the enclosure 14 and facilitates the handling and manipulation of the device 12 in a convenient manner, as with a hook-stick. The device 12 is preferably of a type generally not thought of as being manipulable by tools such as hook-sticks or as having the capability to switch loads.

The body 13 of the device 12 is depicted as an elongated, right-circular cylinder, but other shapes are contemplated. The device 12 has a connection point at either end thereof in the form of mounting studs 16, 16*a* denoting a bottom mounting stud and 16*b* denoting a top mounting stud, although any orientation of the device 12 is contemplated. The mounting studs 16 define a major axis 18 of the device 12. Where the body 13 is not a cylinder, the major axis 18 is nevertheless defined by the studs 16, or other connection points, which are here electrically connected to internal elements of the device 12.

Attached to the lower mounting stud 16*a* is an end fitting 20, which serves two functions; namely, mechanically mounting the device 12 in the assembly 10 and connecting the stud 16*a* to one side of an electrical circuit. The end fitting 20 is described in greater detail below with reference to FIGS. 7 and 8. The end fitting 20 cooperates with a lower mounting 22, to be described in more detail later (FIGS. 3–6), to effect the mechanical mounting and electrical connection of the device 12, and to permit demounting of the device 12 if desired. Preferably, such mechanical mounting permits the end fitting 20 to rotate in the mounting 22 so that selective rotation of the device 12 about the mounting 22 may take place. The mounting 22 includes a cable terminal 24, which is connectable to one side of an electrical circuit (not shown) by cable (not shown). The mounting 22 may be supported by an insulator 26 and an angle member 28, with the insulator 26 attached to the enclosure 14, or to another structural member, as is well known.

Attached to the upper mounting stud 16*b* is an end fitting 30 which performs two functions; namely, selectively maintaining the device 12 in a given rotative position, and effecting electrical connection of the stud 16*b* to the other side of the electrical circuit (not shown) in the given rotative position. Cooperating with the end fitting 30 is an upper mounting 32. Both the end fitting 30 and the mounting 32 are described in more detail below. Suffice it to say here that the end fitting 30 is selectively engageable and disengageable with the mounting 32 upon rotation of the device 12 about the mounting 22. When the end fitting 30 and the mounting 32 are engaged, the device 12 is maintained in the given rotative position depicted in FIG. 1 to electrically connect the mounting stud 16*b* to the other side of the circuit (not shown), via a cable terminal 34, which forms a part of the mounting 32. The mounting 32 may be mounted to an insulator 36, which may be attached to the enclosure 14, or to another structural member, as is well known.

FIG. 1 depicts the closed position of the device 12 in which the end fitting 30 engages the mounting 32, and the end fitting 20 engages the mounting 22, electrical circuit (not shown) being completed through the device 12 via the mounting studs 16. FIG. 2 depicts the opened position of the device 12, in which the device 12 has been rotated to disengage the end fitting 30 from the mounting 32 by rotation of the end fitting 20 in the mounting 22. If it is desired to be able to effect disengagement of the end fitting 30 from the mounting 32

(i.e., to open the device 12) with the circuit energized, the mounting 32 may include a circuit-interrupting device 37 of the type shown in co-pending, commonly-assigned patent application, Ser. No. 660,872 filed on Feb. 24, 1976.

Figure 7:
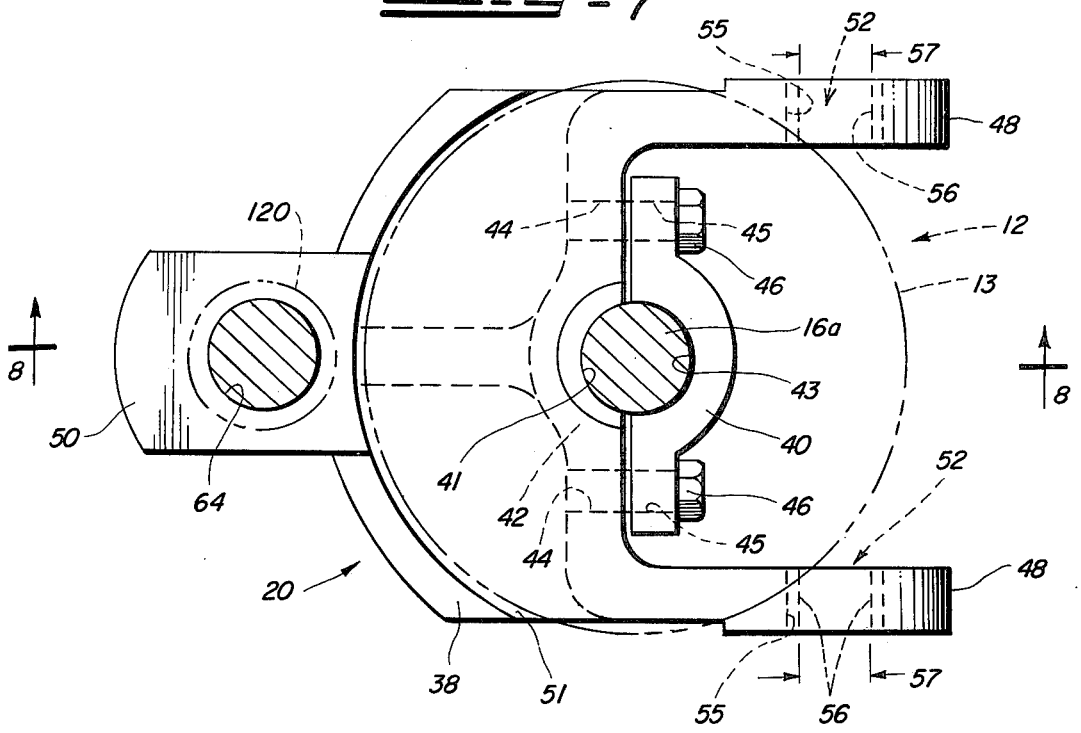
FIG. 7 is a top view of a lower end fitting for the circuit-interrupting device of FIGS. 1 and 2 which cooperates with the mounting of FIGS. 3–6 according to the present invention.
Figure 8:
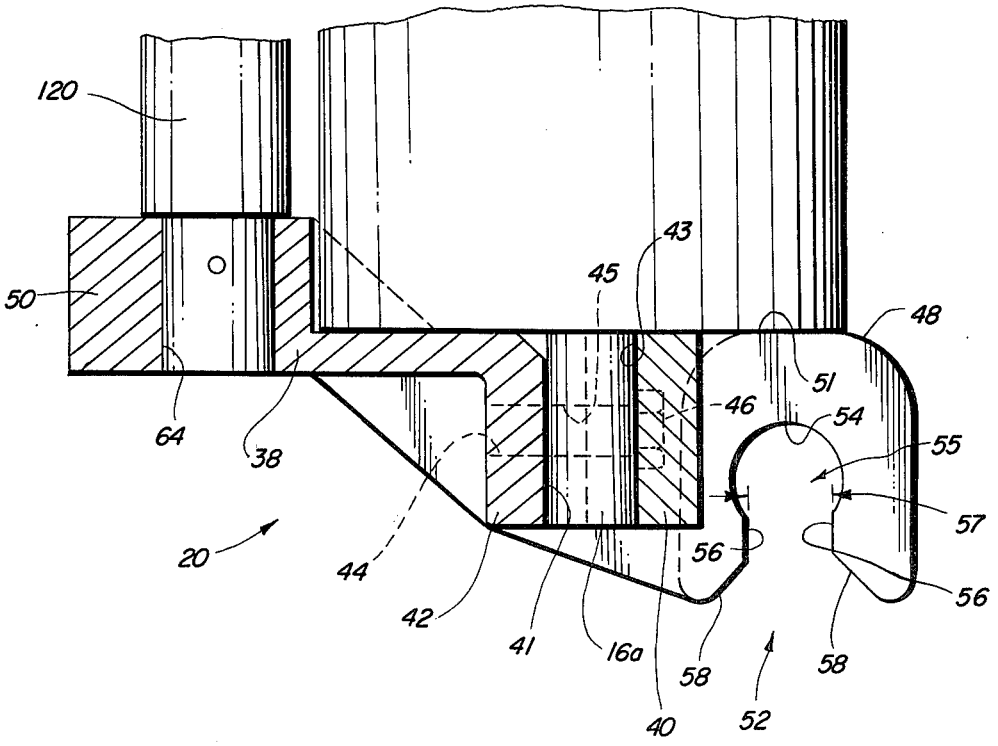
FIG. 8 is a side, elevational, sectional view of the mounting of FIG. 7, taken along line 8—8 thereof.

Referring again to FIGS. 1 and 2, and for more detail in FIGS. 7 and 8, the end fitting 20 is more completely described. The end fitting 20 includes main member 38 and a clamp member 40. A depression 41 is formed in a wall 42 of the member 38, the depression 41 being conformally engageable with a portion of the periphery of the stud 16*a*. The clamp 40 has a similar depression 43. A pair of threaded holes 44 are also formed in the wall 42 on either side of the depression 41. The holes 44 are alignable with a pair of holes 45 formed in the clamp 40 on either side of the depression 43. The stud 16*a* is captured between the depressions 41 and 43, and bolts 46 are run through the holes 45 and screwed into the holes 44 to firmly attach the end fitting 20 to the stud 16*a*. Other elements may be used to attach the end fitting 20 to the stud 16*a*, as should be apparent. Moreover, the major axis 18 of the device 12 need not be perpendicularly related to the member 38 as shown.

The member 38 contains a pair of furcations 48 at one end thereof, extending away from the wall 42. A terminal 50 is integrally formed on the member 38 at the other end thereof, oppositely directed from the furcations 48. A central surface 51 of the member 38, intermediate the furcations 48 and the terminal 50 and overlying the wall 42, supports the end of the device 12 surrounding the stud 16*a*.

The furcations 48 contain slots 52 near the ends thereof. The slots 52 are formed through the furcations 48 and extend from an open end 53 to a closed end 54, which takes the preferred form of an enlargement 55. Flat edges 56 of the slots 52 are preferably parallel and define therebetween a width 57 smaller than any diametric dimension of the enlargement 55. The edges 56 may terminate at the open end 53 in sloping walls 58 which flare outwardly from the slots 52.

The enlargement 55 is preferably circular, as shown, for a purpose to be described below. However, it may have other shapes. Accordingly, the term "diametric dimension" applied to the enlargement 55 refers to the length, along the diameters of an imaginary circle circumscribing the enlargement 55, between opposed peripheral portions of the enlargement 55. Moreover, the edges 56 need not be parallel or flat, but may be otherwise related and shaped. Accordingly, the term "width" applied thereto means the minimum distances measured between the edges 56 transversely of the slots 52. Thus, according to the preferred form of the present invention, no "width" is equal to or larger than any "diametric dimension".

The opposed directions of extension of the terminal 50 and of the furcations 48 are generally perpendicular to the major axis 18 of the device 12, while the direction of extension of the slots 52 is generally parallel to this major axis 18 and forwardly offset therefrom. The main member 38 and the clamp member 40 are preferably made of a conductive metal, such as red brass.

The terminal 50 contains an aperture 64 preferably having an axis generally parallel to the major axis 18 of a device 12. The purpose of this aperture 64 will be discussed shortly.

Figure 3:
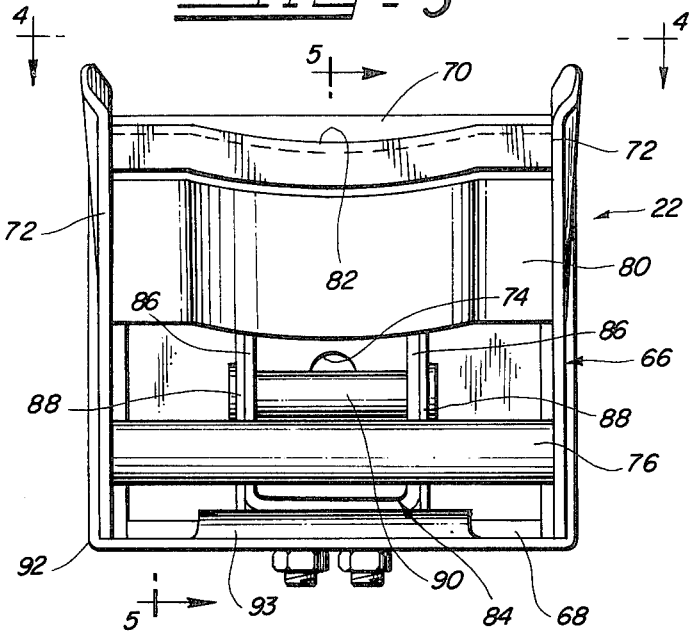
FIG. 3 is a front elevational view of a lower mounting for the circuit-interrupting device shown in FIGS. 1 and 2 constructed in accordance with the principles of the present invention.
Figure 4:
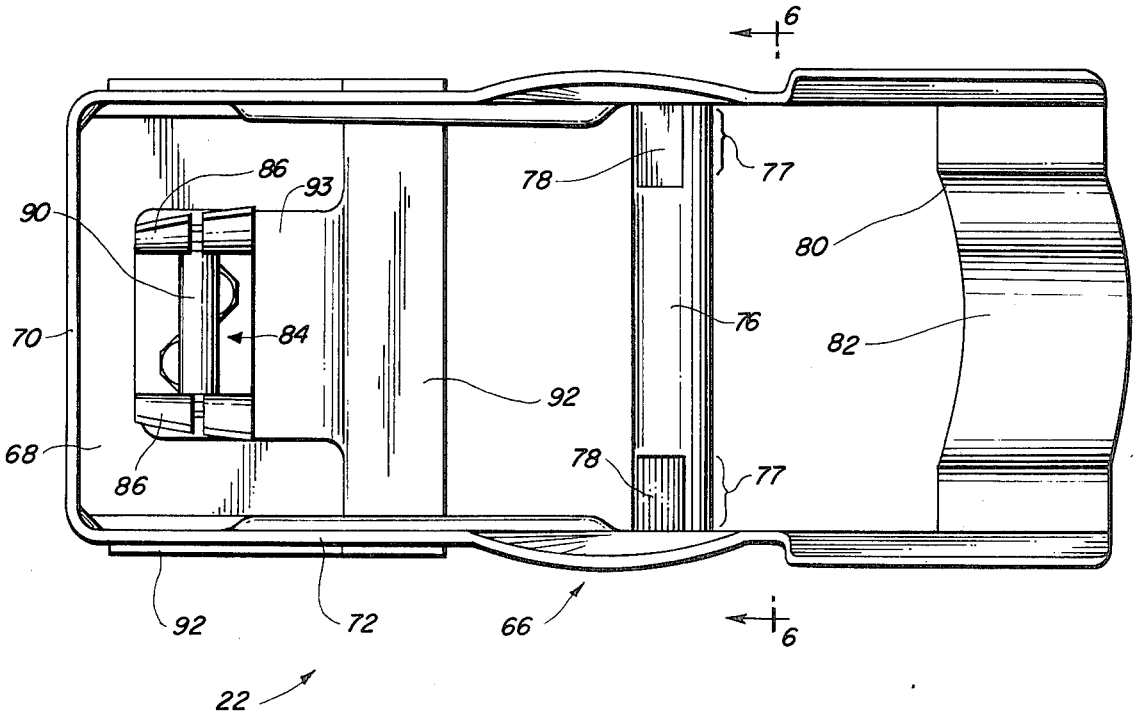
FIG. 4 is a top view of the mounting depicted in FIG. 3 and taken along line 4—4 thereof.
Figure 5:
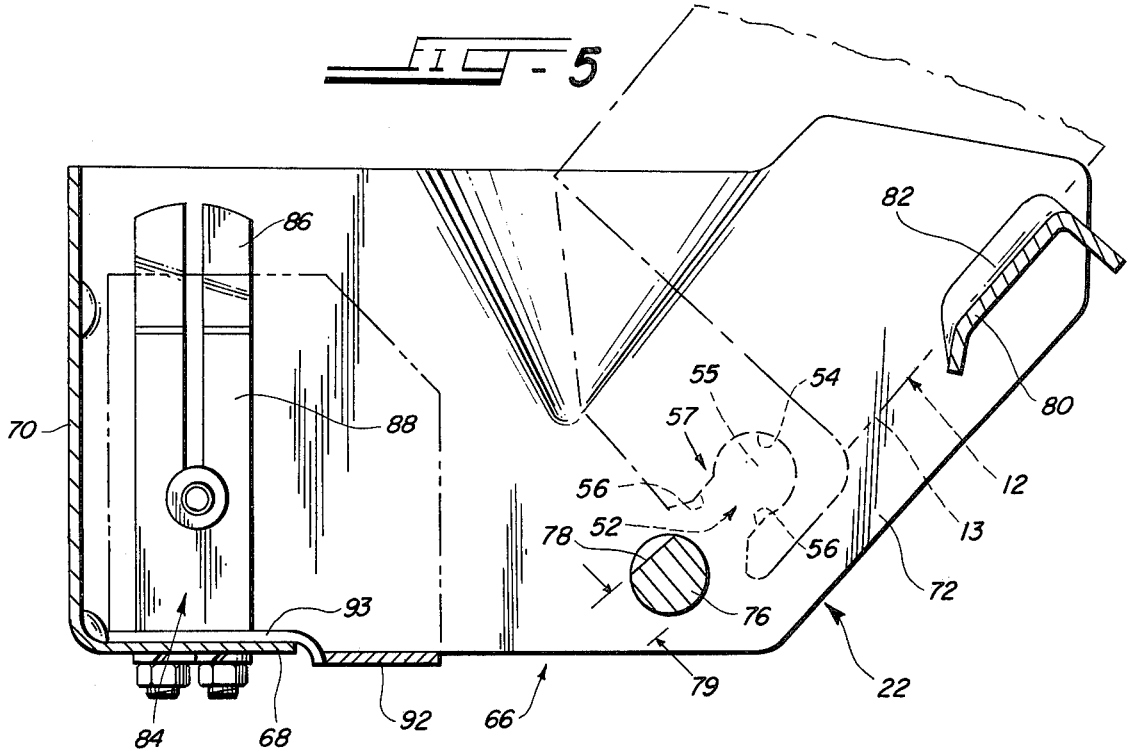
FIG. 5 is a side, elevational, sectional view of the mounting of FIG. 3 taken along line 5—5 thereof.
Figure 6:
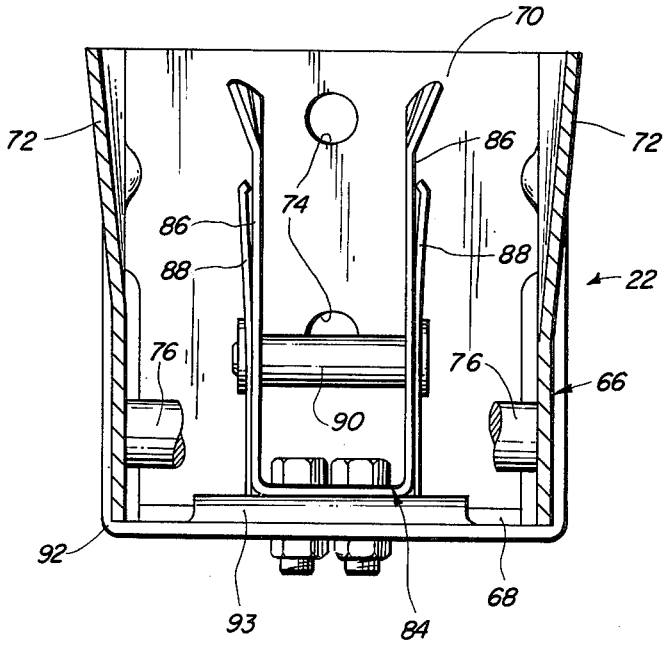
FIG. 6 is a front, elevational, sectional view of FIG. 3 taken along line 6—6 of FIG. 4.

Referring again to FIGS. 1 and 2 and more particularly to FIGS. 3-6, the mounting 22 includes a metal stamping 66 having a bottom wall 68, a front wall 70, and two opposed, preferably parallel side walls 72 extending backwardly from the front wall 70 and beyond the bottom wall 68 as best seen in FIGS. 4 and 5, and is open at the back opposite the front wall 70 (FIG. 3). A pair of holes 74 (FIGS. 3 and 6) may be formed through the front wall 70 to facilitate connection of the mounting 22 to the angle member 28 by any conventional means, such as the bolts 75 shown in FIGS. 1 and 2.

The mounting 22 also includes a pin 76 fixed thereto. Any conventional mode of attachment may be used, mounting of the pin 76 between the side walls 72 of the hinge stamping 66 being preferred. As best seen in FIGS. 1, 2, 4 and 5, outer portions 77 of the pin 76, which is otherwise circular in cross section, contain flats 78 on chords of the circle defined by the pin 76. These flats 78 are spaced apart approximately the same amount as are the furcations 48 and are directed angularly upwardly and forwardly of the mounting 22. The diametric distance 79 between the center of the flats 78 and the circumference of the pin 76 (FIG. 6) is slightly smaller than the width 57 (FIGS. 7 and 8) between the edges 56 of the slots 52. Moreover, the diameter of the pin 76 is slightly smaller than the diameter of the enlargement 55. In place of the pin 76, one or more separated studs with flats thereon, corresponding to the number of furcations 48 on the end fitting 20, may be used. The term "pin" as used herein is intended to cover any such pin, stud or the like, whether elongated or not.

The pin 76 (studs) need not be circular with flats 78 thereon. Rather, the portions 77 may have any noncircular section having an apparent minimum dimension, an apparent maximum dimension and apparent dimensions of intermediate size, all of which are referred to an imaginary circle circumscribing the pin 76 and the periphery of the portions 77 and having its center on an axis of the pin 76. The term "apparent dimension" as used herein means the distance, measured along a diameter of the imaginary circle, between opposed peripheral points of the portions 77 as viewed from about the axis of the pin 76. The terms "apparent maximum dimension" and "apparent minimum dimension" means the largest and the smallest distance similarly measured and viewed. The width 57 between the edges 57 of the slots 52 is slightly greater than the "apparent minimum dimension" of the pin portions 77. Also, the width 57 is smaller than all "apparent dimensions", including the "apparent maximum dimension", larger than the "apparent minimum dimension". Additionally, all "diametric dimensions" of the enlargement 55 are greater than the "apparent maximum dimension" of the pin portions 77.

Mounted near the open top and back of the side walls 72 is a cradle or stop member 80 (FIGS. 1-5). The cradle 80 preferably has a depressed region 82, which is generally conformal to a portion of the body 13 of the device 12. The cradle 80 is preferably welded to the side walls 72.

As best seen in FIGS. 2 and 5, the cradle 80 with the depressed region 82 and the pin 76 with the flats 78 thereon are so angularly related that when the body 13 of the device 12 in the opened position rests near the stud 16*a* on the cradle 80 the upper end fitting 30 may be easily manipulated to align the slots 52 with the pin 76. Such alignment specifically involves manipulating the device 12 with the cradle 80 as a support and pivot until one slot edge 56 is tangent to the circumference of the pin 76, and the other slot edge is coplanar with the chord on which the flat 78 is formed. In the more general case such manipulation of the device 12 aligns the slots 52 with the noncircular portions 77 so that the "width " of the slots 52 at the open end 53 is parallel to the "apparent minimum dimension" of the pin portions 77. In either event, once such alignment is effected, the upper end fitting 30 is easily manipulated to permit the slots 52 to slide over and receive the pin 76 until the pin portions 77 reside within the enlargements 55. Such manipulation involves movement of the device 12 along the axis 18 toward the mounting 22 as the body 13 slides over the cradle 80 by which it is supported.

Preferably, as seen in FIGS. 2 and 5, the surface of the depressed region 82 is generally parallel with the plane of the flats 78 and is spaced transversely from the plane of the flats 78 so that, with a device body 13 of a given size, the desired alignment of the pin 76 and the slots 52 is easily achieved. Of course, the cradle 80 may take other forms, such as pins or the like, in which event some additional, but easily performed, manipulation of the device 12 may be necessary to achieve the desired alignment.

Relative sliding motion of the pin 76 and the slots 52, as well as motion of the device 12 along its axis 18 toward the mounting 22, are the only motions possible for the end fitting 20 and the device 12 as long as the pin 76 is received in the slots 52. This follows from the fact that the slot 52 can receive and accommodate the pin 76 in only one orientation of the device 12 and the end fitting 20, namely, when the apparent minimum dimension of the pin 76 is properly presented to the open end 52 of the slots 52. Stated another way, when the pin 76 has entered the slots 52 no rotation of the device 12 about the pin 76 can occur.

Connected by any conventional means to the bottom wall 68 of the stamping 66 adjacent the front wall 70 is a generally U-shaped contact 84 including a pair of generally upstanding legs 86. The distance between the opposed surfaces of the legs 86 is slightly less than the thickness of the terminal 50 as viewed in FIG. 7. This distance may be maintained by a pair of leaf springs 88 bearing against the outside of the legs 86. Rigidity may be imparted to the U-shaped contact 84 by a spacer 90 attached between the legs 86 by any conventional means. Encompassing a part of the stamping 66 on the outside of the front walls 72 thereof, and near the front wall 70, may be a connector bus 92 which is interposed between the terminal 24 attached by conventional means to one of the side walls 72. A part 93 of the connector bus 92 may also be interposed between the contact 84 and the bottom wall 68. The bus 92 is made of a highly conductive but low strength metal. The bus 92 ensures good electrical conduction between the various interconnected elements of the mounting 22, which are made of metal having high strength, but not necessarily high electrical conductivity.

Assuming that the pin 76 is within the enlargements 55, rotation of the end fitting 20 in the mounting 22 and of the device 12 about the pin 76 may selectively occur upon appropriate manipulation of the end fitting 30. This follows from the fact that all diametric dimensions of the enlargement 55 are larger than the apparent maximum dimension of the pin portions 77.

The device 12 may accordingly be rotated about the pin 76 from the opened position where the body 13 rests against the cradle 80 (FIG. 2) to the closed position where the end fitting 30 is engaged by the mounting 32 (FIG. 1). To move the device 12 to the opened position, rotation thereof is effected in an opposite direction. Rotation of the device 12 in both directions may conveniently be effected by appropriate manipulation of the upper end fitting 30. Rotation toward the opened position (FIG. 2) continues until the body 13 of the device 12 abuts, and is stopped by, the cradle 80. The position of the cradle 80 is related to the flats 78 on the pin 76, and to the slots 52, so that only in this open position may the end fitting 20 be disengaged from the mounting 22 by lifting the device 12 and moving it along its major axis 18 upon application of a maniuplative force to the end fitting 30. In no other rotational position of the device 12 can it be so lifted. This follows from the fact that once the pin 76 is in the enlargement 55, and the enlargement 55 and the slots 52 relatively rotate so that the apparent minimum dimension of the pin portions are not parallel to the slot width 57, apparent dimensions of the pin 76 larger than the slot width 57 are presented thereto. As the device 12 is lifted, the edges 56 slide over the minimum apparent dimension of the pin portions 77 which are provided by the flats 78 in the preferred embodiment.

Thus, the end fitting 20 on the device 12 is engageable with and disengageable from the mounting 22 in only one orientation thereof and of the device 12, namely, when its body 13 rests against the cradle 80. Moreover, once the pin 76 enters the enlargement 55, the device 12 is freely rotatable about the pin 76.

During the rotation of the device 12, the terminal 50 cooperates with the legs 86 of the U-shaped contact 84 to ensure good electrical contact between the end fitting 20 and the mounting 22. Specifically, since rotational or pivotal contact between conductive parts is not considered to provide reliable electrical contact, the reception of the pin 76 in the slots 52 is not relied on for such good electrical contact. Rather, the terminal 50 is intimately slideably engaged by the legs 86 of the U-shaped contact 84 during some of the rotation of the end fitting 20 in the mounting 22 and when the device 12 is in the closed position (FIG. 1). More specifically, in the closed position of the device 12, the terminal 50 rests between the legs 86 which, under the action of the leaf springs 88, maintain good electrical contact to the terminal 50. When the device 12 is rotated between the opened and closed positions, the terminal 50 slides along a curved path against such legs 86 and a self-cleaning, wiping action is achieved. When the device 12 is opened (FIG. 2) the dimensions and orientation of the terminal 50 and of the legs 86 are such that electrical contact therebetween is broken.

A feature of the present invention is the rotation of the device 12, through the cooperation of the slots 52 and the pin 76 about a pivot point which is forward of the device 12; that is, toward an operator who manipulates the device 12 by the end fitting 30 to open or to close the device 12. This location of the pivot point defined by the enlargements 55 and the pin 76 facilitates the initial sliding engagement of the end fitting 20 and the mounting 22, in that the weight of the device 12 slides it down along the cradle 80 until the pin 76 enters the slots 52 with little or no manipulation of the end fitting 30 being necessary. Additionally, the sliding contact between the terminal 50 and the legs 86 which provides the self-cleaning action is facilitated by the location of the terminal 50 diametrically opposite the slots 52 and the pin 76, and permits the legs 86 to have an upstanding, vertical orinetation as opposed to the generally-used horizontal orientation found in prior art support assemblies.

Returning to FIGS. 1 and 2, the end fitting 30 includes a conductive main member 94. The main member 94 includes a depending wall portion 96 which is generally conformally engageable with the upper mounting stud 16*b*. The end fitting 30 is attached to the upper mounting stud 16*b* by a conductive clamp member 100, similar to the member 40 and which is conformally engageable with the upper mounting stud 16*b*. The upper mounting stud 16*b* is trapped between the wall portion 96 and the clamp member 100 by attaching the clamp member 100 to the wall portion 96 by any conventional means, such as the bolts 103 shown, in a manner similar to attachment of the end fitting 20 to the stud 16*a*.

The upper end fitting 30 also includes an extension 106 having an aperture 108 therein forward of the wall portion 96. When the end fittings 20 and 30 are mounted to their respective studs 16*a* and 16*b*, the apertures 64 and 108 are aligned parallel to the axis 18 of the device 12.

The main member 94 contains an upstanding conductive stud 110 and a latching mechanism, generally depicted at 112, both of which are described in the above noted co-pending, commonly-assigned patent application. The latching mechanism 112 includes a pull ring 114 which facilitates manipulation of the device 12 by a hookstick, as well as peforming the function of selectively latching the upper end fitting 30 to the mounting 32 to hold the device 12 in the closed position (FIG. 1). The stud 110 is selectively engageable by contacts 116 which form a part of the interrupter 37, as more completely described in the above-noted co-pending patent application. To open the device 12, a hookstick, or similar device, is inserted into the pull ring 114 and is pulled generally horizontally back. This action causes the latching mechanism 112 to mechanically release itself from the interrupter 37, moving the stud 110 and the contacts 116 engaging it. Such movement of the contacts 116 effects circuit interruption within the interrupter 37. Following such circuit interruption, the stud 110 is disengaged by the contacts 116, whereupon the device 12 may be moved to its full open position, as shown in FIG. 2, whereat the body 13 of the device 12 rests against the cradle 80. It is understood that the mounting 32 need not include the interrupter 37, and may include any conventional contact structure for engaging the stud 110 or other portion of the end fitting 30 should the stud 110 not be included. Moreover, latching mechanisms, other than that shown at 112, may be used.

Once the device 12 is opened, the hookstick may be used to lift the device 12 along the axis 18 so as to slidingly disengage the end fitting 20 and the mounting 22, as described above. The device 12 may now be removed from the enclosure 14. The device 12 may similarly be placed in the enclosure 14. The pull ring 114 is first engaged by the hookstick and the device 12 manipulated until its body 13 rests on the cradle 80 between the end fittings 20 and 30 to align the pin 76 and the slots 52, as described earlier. Once such alignment is achieved, the device 12 is permitted to move axially down to slidingly engage the pin 76 and the slots 52 until the pin 76 enters the enlargements 55. At this time, pushing action of the hookstick on the pull ring 114 closes the device 12 so that the stud 110 engages the contacts 116 and the latching mechanism 112 mechanically latches to the interrupter 37 or other structure of the mounting 32.

In a preferred embodiment, carried in and held by the apertures 64 and 108, is a non-conductive, rigid strut 120. The strut 120 effects at least three ends. First, the strut 120 provides mechanical rigidity between the end fittings 20 and 30. Specifically, the device 12 may be massive and it may be the case that the mounting studs 16 are not designed to withstand high mechanical stress and strain in view of the normal manual, dead circuit handling of the device 12. Accordingly, the strut 120 mounts and fixes the relative positions of the end fittings 20 and 30 without depending on any great amount of mechanical strength or rigidity of the studs 16 on the device 12. Second, the strut 120 fixes the distance between the fittings 20 and 30 along the major axis 18 of the device 12. Such action is necessary to ensure that proper electrical contact between the end fitting 20 and its mounting 22 on the one hand, and the end fitting 30 and its mounting 32 on the other hand, is maintained. Such distance fixing is also necessary from a mechanical standpoint. For example, should the distance between the end fittings 20 and 30 change substantially, the stud 110 could become unable to properly engage the contacts 116. In this event, the latching mechanism 112 might not properly hold the device 12 in its closed position. Third, the strut 120 maintains the angular alignment of the end fittings 20 and 30. The strut 120 also ensures that when the end fittings 20 and 30 are mounted to the studs 16 of the device 12, a predetermined angular alignment will be automatically effected.

Some positional relationships are preferred in the present invention. First, the point of contact between the stud 110 and the contacts 116 is on the periphery of an imaginary circle having the pin 76 and the enlargements 55 as a center. Moreover, opening rotation of the device 12 results in movement of the contacts 116 along a line generally tangent to such imaginary circle. Second, a line defined by (a) the point of engagement between the stud 110 and the contacts 116 when the device 12 is closed, and (b) the pin 76 in the enlargements 55, is generally vertical in the closed position of the device 12. Preferably, the line 110/116-76/55 crosses the axis 18 between the end fittings 20 and 30. This ensures that manipulation of the pull ring 114 to open the device 12 exerts maximum force on the stud 110 and the contacts 116 to ensure both operation of the interrupter 37 and ultimate separation of the stud 110 from such contacts 116. Third, a line generally defined by the pull ring 114 and the pin 76 in the enlargements 55 is on one side of, and is preferably generally parallel to, the axis 18 of the device 12; while a line defined by the stud 110 and the apertures 64 and 108 is on the other side of the axis 18 and is preferably parallel thereto. Preferably, neither line 113/76/55 or line 110/64/108 crosses the axis 18 between the end fittings 20 and 30.

Although certain preferred embodiments of the present invention are described in the foregoing detailed description, it should be understood that this invention is not limited to those specific embodiments but is capable of modification and rearrangement. For example, facilities other than the depicted noncircular pin portion 77, the slot 52 and the enlargement 55 are contemplated for permitting slideable engagement/disengagement of the end fitting 20 and the mounting 22, as well as the mutual rotation thereof. Specifically, the end fitting 20 may have the pin 76 (or stud) thereon while the mounting 22 has one or more slots 52. Moreover, the pin 76 and the slot 52 may be regularly configured and the slot may have no enlargement 55. In this latter event other devices, such as guide surfaces on the mounting 22 (or end fitting 20), may coact with cooperating faatures on the end fitting 20 (or mounting 22) to permit the slideable engagement/disengagement and mutual rotatability thereof.

I claim:

1. An improved support assembly for a circuit-interrupting device having first and second end fittings on respective ends thereof, the end fittings defining the major axis of the device and being engageable with and disengageable from respective first and second mountings spaced apart in the assembly in insulated relation; a hookstick held by a human operator being selectively attachable to the first end fitting for manipulating the device to engage and disengage the end fittings and their respective mountings; wherein the improvement comprises:

first means for permitting slideable engagement and disengagement of the second mounting and the second end fitting in only one orientation of the second end fitting;

second means for permitting rotation of the second end fitting in the second mounting after slideable engagement therebetween to rotate the device about the second mounting; and third means for supporting the device to position the second end fitting in the one orientation.

2. The support assembly of claim 1, wherein the first means comprises:

an elongated pin fixed to the second mounting, the pin having a noncircular portion with apparent maximum and minimum dimensions when viewed from about the longitudinal axis of the pin; and an elongated slot for slideably receiving the noncircular portion, the slot being formed in the second end fitting and having an open first end, a closed second end, and a transverse width greater than the apparent minimum dimension and smaller than all other apparent dimensions.

3. The support assembly of claim 2, wherein the second means comprises:

an enlargement at the second end of the slot for slideably and rotatably receiving the noncircular portion, the diametric dimensions of the enlargement being greater than the apparent maximum dimension.

4. The support assembly of claim 2, wherein the third means comprises:

cradle means on the second mounting for supporting the device to align the slot with the noncircular portion so that the width of the slot is parallel to the apparent minimum dimension.

5. The support assembly of claim 4 wherein the cradle means supports the device intermediate the end fittings.

6. The support assembly of claim 5, wherein the cradle means slideably supports the device during the sliding engagement and disengagement of the second end fitting and second mounting.

7. The support assembly of claim 5, wherein the second means permits sufficient rotation of the second end fitting in, and of the device about, the second mounting to effect selective engagement and disengagement of the first end fitting and the first mounting; and wherein the cradle means supports the device to arrest rotation of the device following disengagement of the first end fitting and first mounting.

8. The support assembly of claim 4, wherein the second means permits sufficient rotation of the second end fitting in, and of the device about, the second mounting to effect selective engagement and disengagement of the first end fitting and the first mounting, and wherein the cradle means supports the device intermediate the end fittings to slideably support the device during sliding engagement and disengagement of the second end fitting and second mounting, and to arrest rotation of the device following disengagement of the first end fitting and first mounting.

9. The support assembly of claim 8, which further comprises:

a terminal on the second mounting; and contact means on the second end fitting for slideably contacting the terminal during a part of the rotation of the device and second end fitting, and for contacting the terminal when the first end fitting and the first mounting are engaged.

10. The support assembly of claim 9 wherein the slot enlargement is on the same side of the major axis of the device as the point of hookstick attachment to the first end fitting and is on an opposite side of the major axis from the contact means and from the point of engagement of the first end fitting with the first mounting.

11. The support assembly of claim 10 wherein a first line is defined by the slot enlargement and the point of hookstick attachment to the first end fitting;

a second line is defined by the contact means and the point of engagement of the first end fitting with the first mounting; and neither line intersects the major axis of the device between the end fittings.

12. The support assembly of claim 11 which further comprises means connected between the end fittings for maintaining the relative spacing and angularity thereof.

13. The support assembly of claim 12 wherein the maintaining means comprises an insulative strut lying generally along the second line and attached at either end to the end fittings.

14. The support assembly of claim 13 wherein the second line is generally parallel to the major axis of the device.

15. The support assembly of claim 14 wherein the contact means comprises an elongated extension integrally with the second end fitting.

16. The support assembly of claim 15 wherein the terminal comprises an elongated spring-biased finger.

17. The support assembly of claim 16 wherein an axis of the contact means extension is generally perpendicular to the second line and to the major axis of the device; and an axis of the finger is generally parallel to the second line and to the major axis of the device when both end fittings engage their respective mountings.

18. The support assembly of claim 1, wherein the first means comprises a generally cylindrical pin fixed to the second mounting; the pin having a flat formed on a chord of the cross section thereof; and an elongated slot formed in the second end fitting, the slot having opposed edges separated by a distance greater than the minimum diametric distance between the chord and the periphery of the pin but less than the diameter of the pin.

19. The support assembly of claim 18, wherein the second means comprises a circular enlargement at an end of the slot, the enlargement having a diameter greater than the diameter of the pin.

20. The support assembly of claim 19 wherein the third means comprises a cradle on the second mounting for supporting the device to align the slot with the pin so that one slot edge is coplanar with a tangent to the pin and the other slot edge is coplanar with the chord.

21. The support assembly of claim 1 wherein the rotation of the device about the second mounting is between an opened position and a closed position, the first end fitting engaging the first mounting in the closed position and being disengaged from the first mounting in the opened position, and wherein the third means comprises cradle means on the second mounting for supporting the device in the opened position.

22. The support assembly of claim 21, wherein the cradle means slideably supports the device during the sliding engagement and disengagement of the second end fitting and second mounting.

23. The support assembly of claim 22, wherein the cradle means supports the device intermediate the end fittings.

24. An improved support assembly for a circuit-interrupting device having first and second end fittings on respective ends thereof, the end fittings being engageable with and disengageable from respective first and second mountings spaced apart in the assembly in insulated relation; the device being manipulable to engage and disengage the end fittings and their respective mountings; the second mounting and the second end fitting being slideably engageable and disengageable; the second end fitting being rotatable in the second mounting after slideable engagement therebetween to rotate the device about the second mounting between a closed position where the first end fitting and mounting are engaged and in opened position where the first end fitting and mounting are disengaged; wherein the improvement comprises:

cradle means on the second mounting for supporting the device in the opened position and for slideably supporting the device during sliding engagement of the second end fitting and mounting.

25. The support assembly of claim 24, wherein the cradle means supports the device intermediate the end fittings.

* * * * *